United States Patent [19]

Smith

[11] 4,240,220

[45] Dec. 23, 1980

[54] REFLECTOR WITH ILLUMINATED INDICIA

[76] Inventor: Barry Smith, 554 W. 38 St., New York, N.Y. 10018

[21] Appl. No.: 33,528

[22] Filed: Apr. 26, 1979

[51] Int. Cl.[3] ..... G09F 13/08

[52] U.S. Cl. ..... 40/564; 40/580; 40/582; 40/615; 40/616

[58] Field of Search ..... 40/564, 582, 615, 205, 40/219, 577, 616, 556, 579, 580, 204, 206

[56] References Cited

U.S. PATENT DOCUMENTS

| | | | |
|---|---|---|---|
| 1,786,155 | 12/1930 | Farrell | 40/580 |
| 1,888,584 | 11/1932 | Cadieux | 40/580 |
| 3,973,342 | 8/1976 | Gubela | 40/582 |

FOREIGN PATENT DOCUMENTS

| | | | |
|---|---|---|---|
| 1447448 | 11/1968 | Fed. Rep. of Germany | 40/582 |
| 15928 | of 1897 | United Kingdom | 40/580 |
| 306668 | 2/1929 | United Kingdom | 40/205 |
| 360153 | 11/1931 | United Kingdom | 40/219 |

*Primary Examiner*—John F. Pitrelli

*Attorney, Agent, or Firm*—Frishauf, Holtz, Goodman & Woodward

[57] ABSTRACT

A reflector with illuminated indicia, such as for automotive use, comprising a translucent sheet-like material having reflecting elements on at least a portion of at least one surface thereof and indicia defining means on the rear surface portion of said translucent sheet-like material; reflecting material on the reflecting elements but not on the indicia; a dark, translucent material adjacent to the indicia on the rear surface portion of the translucent sheet-like material; translucent diffusing material adjacent the dark translucent material and located more remote from the translucent sheet-like material than the dark translucent material; and a source of illumination rearward of the translucent material. The invention is also directed to a method of making such a reflector and a method of modifying conventional reflectors.

12 Claims, 7 Drawing Figures

FIG. 1
PRIOR ART
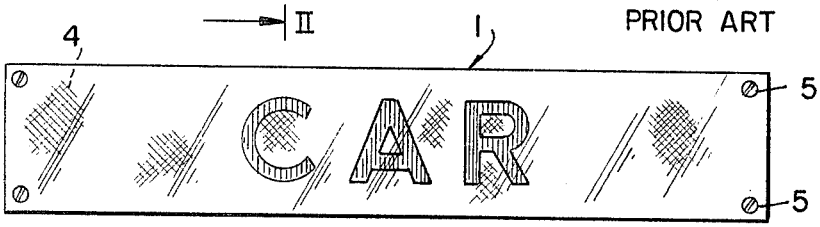
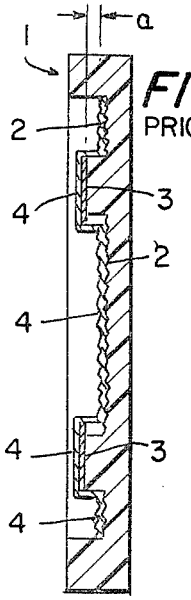
FIG. 2
PRIOR ART
FIG. 3
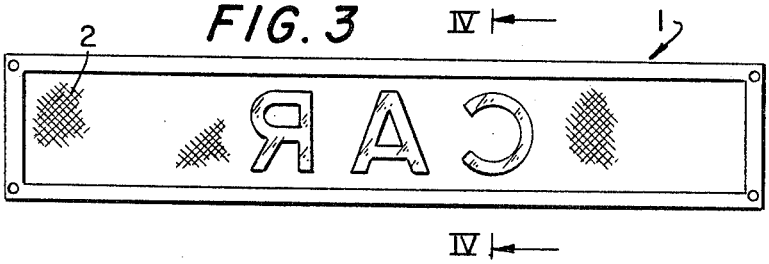
FIG. 5
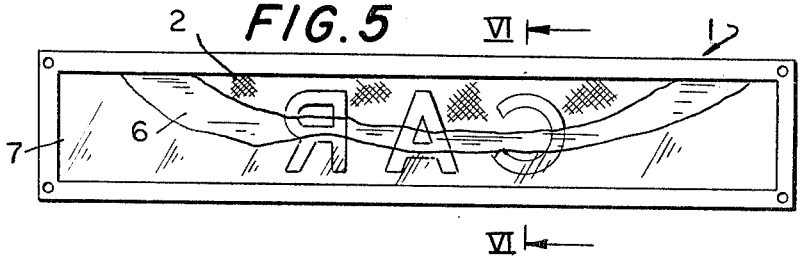
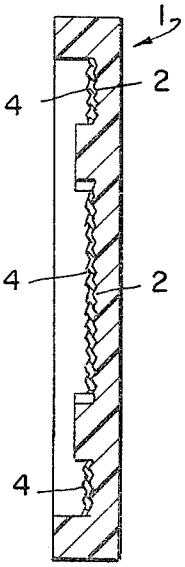
FIG. 4
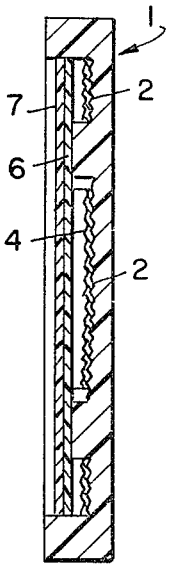
FIG. 6
FIG. 7
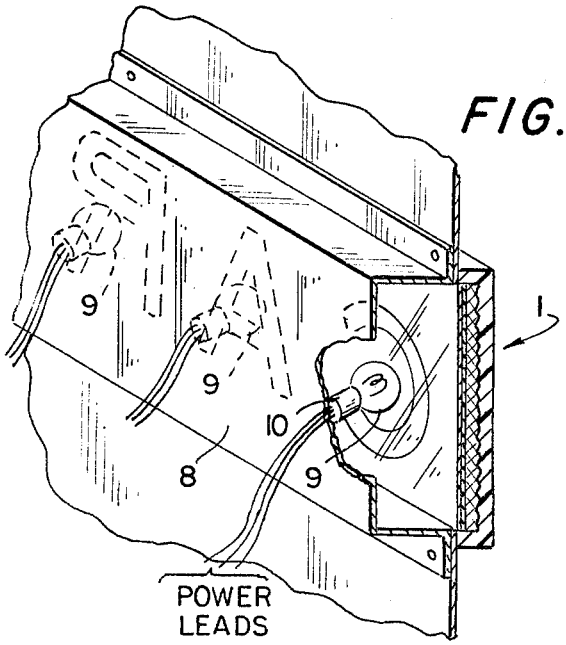

REFLECTOR WITH ILLUMINATED INDICIA

BACKGROUND OF THE INVENTION

This invention relates to reflectors with illuminated indicia thereon. The invention also relates to modifying existing reflectors to permit rear illumination of indicia thereon, and kits for modifying existing reflectors.

In automobiles, wide use is made of reflectors for decorative and safety purposes. Some reflectors, such as those used on the rear of an automobile, have indicia thereon, for example the name of the automobile. In some instances, the name of the automobile appears on the reflector in black or another dark color, the remaining portion of the reflector generally being red. During daylight the dark colored name can be observed. At night, however, the name of the automobile does not become illuminated when the automobile running lights are switched on.

The object of the present invention is to provide a reflector in which the indicia thereon appears to be dark in color, and is thus easily readable in daylight, and which is illuminated when the automobile running lights are switched on, to thereby illuminate the name of the automobile, or other indicia, so as to be readable also at night.

A further object of the invention is to modify existing reflectors with dark colored indicia thereon, to provide a reflector in which the indicia appears to be dark and is easily readable in daylight, and which may be illuminated at night so as to also be readable at night.

A further object of the invention is to provide such a reflector which is illuminated in a different color than it appears when non-illuminated during daylight.

SUMMARY OF THE INVENTION

According to the present invention, a reflector comprises a translucent sheet-like material (1) having reflecting elements (2) on at least a portion of at least one surface thereof; means defining indicia on a rear surface portion of the translucent sheet-like material (1); reflecting material on the reflecting elements, but not on the indicia defining means; a dark, translucent material (6) adjacent the indicia defining means on the rear surface portion of the translucent sheet-like material (1); and translucent diffusing material (7) adjacent the dark translucent material (6) and located more remote from the translucent sheet-like material (1) than the dark translucent material (6). Also provided is a light source behind the translucent diffusing material (7).

BRIEF DESCRIPTION OF THE DRAWINGS

FIG. 1 is a front view of a reflector of the general type to which the present invention pertains, in the unmodified form;

FIG. 2 is a cross-sectional view of the reflector of FIG. 1 taken along the line II—II;

FIG. 3 is a rear view of the reflector of FIGS. 1 and 2, in the partially modified form;

FIG. 4 is a cross-sectional view of the reflector shown in FIG. 3 taken along the line IV—IV;

FIG. 5 is a rear view of the modified reflector assembly, in partially broken-away form;

FIG. 6 is a cross-sectional view of the modified reflector of FIG. 5 taken along the line VI—VI; and FIG. 7 illustrates a rear perspective view of the reflector of FIGS. 5 and 6 mounted to an automobile with a light reflecting cavity behind same and with illuminating light bulbs mounted adjacent the rear portion of the reflector.

DETAILED DESCRIPTION

FIGS. 1 and 2 illustrate a reflector 1 of the general type to which the present invention pertains, the reflector being shown in the unmodified form. The complete reflector has conventional reflecting characteristics, except for the portion indicating the indicia "CAR". As best seen in FIG. 2, the rear surface 2 of the reflector, over substantially the complete surface thereof except where the indicia CAR appears, has an irregular or prismatic type of surface, as is conventional in the reflector art. The surface behind and defining the indicia CAR is smooth and has a black or other dark opaque layer 3 thereon, for example black paint. The reflector material, which is preferably plastic, even over the area of the indicia CAR, is translucent red, as is conventional in the reflector art. The prismatic rear surface 2 is covered with a reflecting layer 4, such as reflecting paint, reflecting tape, or any other suitable reflecting layer. The reflecting layer 4 may be applied over the dark opaque layer 3 as seen in FIG. 2. The reflecting layer 4 is sometimes covered with another protective layer, not shown. Due to the black or other dark colored layer 3 on the rear surface of the indicia CAR, the indicia CAR appears to be black or a dark color when viewed as in FIG. 1, while the surrounding surface of the reflector appears red. At night, the indicia CAR is difficult or impossible to distinguish. The reflector of the type shown in FIGS. 1 and 2 is generally mounted to a rear body panel of an automobile, for example by means of screws 5.

FIGS. 3 and 4 illustrate a partially modified reflector wherein reflecting layer 4 and the black or other dark colored layer 3 on the rear surface directly behind the indicia CAR has been removed, for example by shaving, grinding, filing or other suitable method. Chemical removal methods may be used if the chemicals do not destroy the reflector plastic material, but care should be taken to remove as little as possible of the reflecting layer 4 over the remaining prismatic rear surface 2 of the reflector. After removing the dark layer 3, the rear surface of the indicia CAR is polished in order to remove as many imperfections as possible and to provide as smooth a surface as possible. After removal of the dark layer 3, the indicia CAR in the reflector appears to the viewer as being translucent red throughout. Any reflecting material 4 inadvertently removed from the prismatic surface 2 during the above process must be replaced. The replacement material 4 can be paint, reflecting tape, etc.

In order to have the translucent red indicia CAR appear to be dark in color from the outside under daylight conditions, as seen in the view of FIG. 1, a sheet of dark translucent material, such as a neutral density filter gel 6, is placed behind the indicia CAR, as shown in FIG. 5.

In order to provide substantially even illumination from the rear, a white translucent diffuser sheet 7 is placed behind the neutral density filter 6, also as shown in FIG. 5. As a result, when viewed from the outside in the direction of FIG. 1, under daylight conditions, the indicia CAR appears to be dark in color, i.e. substantially black, even though the indicia CAR is generally of red translucent material which is backed by the dark translucent layer 6.

When the reflector of FIG. 5 is mounted over a body cavity 8 of an automobile, for example as shown in FIG. 7, with illumination from the rear, under nighttime conditions, the indicia CAR appears to be red in color (the translucent red of the reflector material) when the illuminating bulbs 10 are energized. This produces a soft glowing effect to the indicia CAR which is attractive. If the illuminating bulbs 9 are dual filament bulbs, and are also connected to the brake lights of the automobile, the illumination is increased to a higher level when the brakes are applied (by energizing the second filament in the bulbs) so that the indicia CAR also serves as an additional brake light for the automobile, thereby improving safety.

To provide the most even illumination, it is preferable that one bulb 9 be provided behind each of the letters of the indicia CAR. The bulbs are preferably mounted in sockets 10 which may be fixedly mounted to the body cavity 8 or which may be removably mounted to facilitate replacement of the bulbs 9. The power leads for the bulbs 9 are connected to the lighting power source and the brake light power source, respectively. When the reflector device is installed near a muffler or other high heat components of the vehicle, the power leads are preferably 16 gauge 500° nickel wire with silicone-asbestos insulation. The bulbs 9 are preferably grounded through the metallic body cavity 8. Where the body cavity 8 is formed of a plastic or other insulating material, a separate ground wire (not shown) is provided for the bulbs 9.

The cross-sectional dimensions of the reflector and the various layers thereon have been exaggerated for ease of illustration. In a practical operational embodiment, the plastic sheet-like neutral density filter gel 6 is about 3.5 mm thick, the plastic sheet-like translucent diffuser 7 is about 1.5 mm thick, and the dimension "a" in FIG. 2 is about 1 mm. These dimensions are typical, but are by no means limiting of the present inventive concept. The filter 6 and diffuser 7 may be adhered together, for example, around their periphery by a suitable adhesive.

While the above discussion is given with respect to modifying an existing reflector assembly, it should be clear that the present inventive concept also applies to original manufacturing of the reflector assembly in accordance with the invention. In an original manufacturing technique, the reflector 1 is fabricated in a manner similar to the reflector described hereinabove, but the layer 3 is omitted. Also, the layer 4 behind the indicia CAR is omitted. In place of the layers 3 and 4, translucent layers may be provided on the rear of the indicia CAR, similar to the translucent layers 6 and 7 described hereinabove. The layers 6, 7 may be permanently deposited on the rear surface of the indicia CAR or may constitute sheets or other non-permanent elements located behind the indicia CAR. The resulting reflector, in combination with the illumination technique illustrated in FIG. 7, provides substantially the same result as the modified reflector described hereinabove.

A kit for modifying an existing reflector preferably includes a translucent sheet-like neutral density plastic material 6, a plastic sheet-like translucent diffusing material 7 and instructions for modification. The kit could also include tools and materials for removing reflecting or other materials from behind the indicia of the existing reflector and, if desired, a light reflecting enclosure 8 (FIG. 7) with bulbs, sockets and wiring.

The indicia CAR is used for convenience in the description. The indicia may be any other indicia, such as one or more alphanumeric characters, in any combination, or a symbol or other design either alone or in combination with alphanumeric characters. Various modifications may be made to the above described inventive concept within the spirit and scope of the appended claims.

I claim:

1. A reflector having selectively illuminatable indicia which is readable in both its illuminated and non-illuminated states, comprising:

a translucent sheet-like material (1) having front and rear surfaces and reflecting elements (2) on at least a portion of at least one of said front and rear surfaces;

means defining indicia on a rear surface portion of said translucent sheet-like material (1);

reflecting material on said reflecting elements, but not on said indicia defining means;

a dark, translucent, material (6) adjacent the indicia defining means on the rear surface portion of said translucent sheet-like material (1);

translucent diffusing material (7) adjacent said dark translucent material (6) and located more remote from said translucent sheet-like material (1) than said dark translucent material (6); and a selectively energizable light source located behind said translucent diffusing material for selectively illuminating said indicia of said translucent sheet-like material (1), said indicia appearing dark in color when viewed from the front of said translucent sheet-like material (1) and when not illuminated by said light source, and said indicia appearing substantially the same color as said translucent sheet-like material (1) when viewed from the front of said translucent sheet-like material and when illuminated by said light source.

2. The reflector of claim 1 wherein said dark, translucent material is a thin sheet-like material.

3. The reflector of claim 1 or 2 wherein said translucent diffusing material (7) is a thin sheet-like material.

4. The reflector of claim 1 wherein said sheet of dark translucent material is a neutral density filter.

5. The reflector of claim 1 wherein said translucent diffusing material is a substantially white translucent sheet.

6. The reflector of claim 1 wherein said reflecting elements are on the rear surface portion of said translucent sheet-like material (1).

7. The reflector of claim 3 wherein said sheet of dark translucent material is a neutral density filter.

8. The reflector of claim 7 wherein said translucent diffusing material is a substantially white translucent sheet.

9. The reflector of claim 3 wherein said translucent diffusing material is a substantially white translucent sheet.

10. The reflector of claim 3 wherein said reflecting elements are on the rear surface portion of said translucent sheet-like material (1).

11. The reflector of claim 10 wherein said sheet of dark translucent material is a neutral density filter.

12. The reflector of claim 11 wherein said translucent diffusing material is a substantially white translucent sheet.

* * * * *